US005145004A

United States Patent [19]

Cornette

[11] Patent Number: 5,145,004

[45] Date of Patent: Sep. 8, 1992

[54] MULTIPLE GRAVEL PACK WELL COMPLETIONS

[75] Inventor: Holley M. Cornette, Houston, Tex.

[73] Assignee: Atlantic Richfield Company, Los Angeles, Calif.

[21] Appl. No.: 667,938

[22] Filed: Mar. 12, 1991

[51] Int. Cl.[5] ..... E21B 43/04; E21B 43/14

[52] U.S. Cl. ..... 166/278; 166/313

[58] Field of Search ..... 166/228, 276, 187, 278, 166/51, 184, 299, 313, 341

[56] References Cited

U.S. PATENT DOCUMENTS

| | | | |
|---|---|---|---|
| 2,371,391 | 3/1945 | Haynes | 166/51 |
| 2,513,944 | 7/1950 | Kessler | 166/205 |
| 3,115,187 | 12/1963 | Brown | 166/313 |
| 3,735,815 | 5/1973 | Myers | 166/313 |
| 3,823,778 | 7/1974 | Mott | 166/313 |
| 4,105,069 | 8/1978 | Baker | 166/51 |
| 4,143,712 | 3/1979 | James et al. | 166/313 |
| 4,418,754 | 12/1983 | Stepp | 166/278 |
| 4,913,228 | 4/1990 | Setterberg, Jr. | 166/313 |

*Primary Examiner*—Ramon S. Britts
*Assistant Examiner*—Frank S. Tsay
*Attorney, Agent, or Firm*—Drude Faulconer

[57] ABSTRACT

A multiple gravel pack well completion and a method for installing same wherein multiple zones in a wellbore can be gravel packed without the circulation of fluid. Particulate material, e.g. gravel, is preset in the wellbore adjacent the lower zone to be completed and a first auger-liner is "augered" into the preset gravel to form a lower gravel pack completion. A packer is set above the lower zone abd additional gravel placed onto the packer to fill the wellbore adjacent the upper zone. A second auger-liner assembly is augered into the additional gravel to form an upper gravel pack completion. Conduit means are then provided to establish fluid communication between the surface of the wellbore and the upper and lower gravel pack completions.

13 Claims, 3 Drawing Sheets

MULTIPLE GRAVEL PACK WELL COMPLETIONS

DESCRIPTION

1. Technical Field

The present invention relates to multiple gravel pack well completions and in one of its preferred aspects relates to a multiple gravel pack completion and a method for installing same wherein a lower zone is first completed by augering a fluid-permeable liner into gravel which has been preset adjacent the lower zone and then an upper zone is completed by augering another fluid-permeable liner into gravel which has been preset adjacent the upper zone.

2. Background Art

Where a wellbore transverses more than one production or injection zone, it is not uncommon to multiple complete the well so that more than one zone can be serviced through the borehole at the same time. For example, where a well transverses separate production zones, the well is often multiple completed so that the fluids produced from the respective zones can be produced to the surface at the same time, either by commingling the fluids or by producing each through a separate tubing string. For a good description of several different types of known multiple zone completions, see COMPOSITE CATALOG OF OIL FIELD EQUIPMENT AND SERVICES, 35th Revision, 1982-83 Volume 1, pps 772-775, WORLD OIL, Gulf Publishing Co.

However, many of the problems encountered in standard well completions are further complicated by the plural completions in a single wellbore. For example, where separate production or injection zones lie adjacent incompetent subterranean formations (i.e. formations formed of an unconsolidated matrix such as loose sandstone or the like) or lie adjacent formations which have been hydraulically-fractured and propped, serious problems may arise with sand control. These problems occur when large volumes of sand and/or other particulate material (e.g. backflow of proppants from a hydraulically-fractured formation) dislodge from the formation and become entrained in the produced formation fluids. These particulate materials are highly detrimental to the operation of the well and routinely cause erosion, plugging, etc. of the well equipment which, in turn, leads to high maintenance costs and considerable downtime of the well.

While many techniques have been proposed for controlling sand production in a well, probably the most widely-used is one which is generically known as "gravel packing". Basically, a gravel pack completion is one wherein a fluid-permeable liner is positioned within the wellbore (open or cased) adjacent the incompetent or fractured zone and is surrounded by aggregate or particulate material (collectively called "gravel"). As known in the art, the gravel particles are sized to block or filter out the formation particulates from the produced fluids while the openings in the liner are sized to block the gravel and removed particulates from flowing into the liner. This two-stage filtration system is commonly known as a "gravel pack".

There are several known techniques for installing a typical gravel pack completion in a wellbore. For example, one such technique involves positioning the fluid-permeable liner in the wellbore and then placing the gravel around the liner to form the gravel pack. Another technique involves placing the gravel in the wellbore first and then driving, rotating, or washing the liner into the gravel to form the gravel pack. For a good discussion of these techniques, see PETROLEUM PRODUCTION ENGINEERING, Oil Field Development, L. C. Uren, Third Edition, McGraw-Hill Book Co., N.Y., 1946, pps. 575-588.

Another technique for forming a gravel pack completion involves first placing the gravel in the wellbore adjacent the zone to be completed and then "augering" a fluid permeable liner into place within the pre-positioned gravel; see U.S. Pat. Nos. 2,371,391 and 2,513,944. Also see co-pending U.S. application Ser. No. 07/518,046, filed May 4, 1990 and now U.S. Pat. No. 5,036,920, issued Aug. 6, 1991 (commonly-assigned to the present Assignee) which preferably utilizes a commercially-available type of liner having an auger blade attached around its periphery to displace gravel upward as the liner is rotated and lowered into the pre-positioned gravel. This allows the liner to be placed into the gravel without the circulation of fluid thereby maintaining the compactness of the pre-positioned gravel in the wellbore.

As far as is known, heretofore, the gravel packing of multiple zones in a single wellbore has required the circulation of fluid during the installation of the respective liners. Accordingly, the well may experience severe fluid loss problems during installation, especially where the zones to be completed have normal or below normal pressures or pressures which are below the hydrostatic pressure of the completion fluids in the wellbore. In some instances, this loss of expensive completion fluids can be excessive which is not only costly but can also contribute to severe formation damage in many cases.

DISCLOSURE OF THE INVENTION

The present invention provides a muliple gravel pack well completion and a method for installing same wherein multiple zones in a wellbore can be gravel packed without the circulation of fluid. More specifically, particulate material, e.g. gravel, is preset in the wellbore adjacent the lower zone to be completed. A first auger-liner assembly comprised of a fluid-permeable liner having an auger blade about its periphery is lowered on a workstring and is rotated to "auger" the liner into the preset particulate material to form a gravel pack completion adjacent the lower zone. Since the auger blade moves the displaced gravel upward, there is no need to circulate fluid during installation. A packer is set above the lower zone and below an upper zone which is to completed and the workstring is removed.

Additional particulate material is then placed onto the packer to fill the wellbore adjacent the upper zone. A second auger-liner assembly comprised of a second fluid-permeable liner having an auger blade about its periphery is lowered on the workstring and rotated into position within the additional particulate material to form a gravel pack completion adjacent the upper zone. Again, no circulating fluid is needed during installation.

Conduit means are then provided to establish fluid communication between the surface of the wellbore and the upper and lower gravel pack completions in the wellbore. In one embodiment, the conduit extends from the surface through said second fluid-permeable liner and packer, and is connected to the first fluid-permeable liner. The conduit has a sliding sleeve valve positioned within the second fluid-permeable liner which when in an open position allows the fluids from the upper zone to be commingled with the fluids from the lower zones for production to the surface through the conduit.

In another embodiment, the conduit means is comprised of two separate tubing strings which extend from the surface. The first string is fluidly connected to the lower gravel pack completion while the second string is fluidly connected to the upper gravel pack completion whereby the fluids from the upper and lower zones can be produced separately to the surface.

BRIEF DESCRIPTION OF THE DRAWINGS

The actual construction, operation, and apparent advantages of the present invention will be better understood by referring to the drawings in which like numerals identify like parts and in which.

BEST KNOWN MODE FOR CARRYING OUT THE INVENTION

Figure 1:
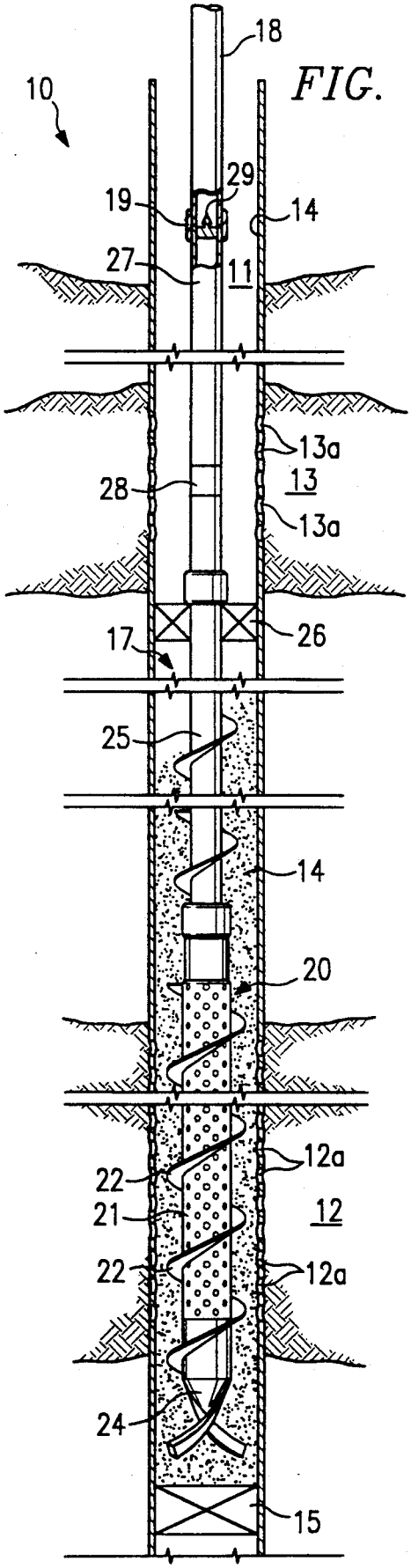
FIG. 1 is an elevational view, partly in section, of an early stage of the multiple gravel pack completion in accordance with the present invention wherein a lower zone in a wellbore has been completed.

Referring more particularly to the drawings, FIG. 1 illustrates a well 10 having a wellbore 11 which transverses multiple zones (e.g. a lower zone 12 and an upper zone 13) which are to be completed in accordance with the present invention. As shown, well 10 has been cased along its length with casing 13 which has been perforated to provide perforations 12*a*, 13*a* adjacent zones 12, 13, respectively. While the present invention is shown and described in relation to completing multiple zones in a cased, vertical wellbore, it should be understood that the invention can also be used for carrying out completions in open holes as well as in horizontal or deviated wells or to prevent proppant flowback in wells which have been hydraulically-fractured and propped.

In those wells where the wellbore extends past the lower completion zone 12, a cement plug, bridge plug or an equivalent-type packer 15 is set in the wellbore at or below the lower end of zone 12 and a gravel pack is installed adjacent zone 12. Preferably, sufficient gravel 14 is then supplied down the wellbore and onto the top of plug 15 to fill the wellbore through the length of zone 12 which is to be completed. "Gravel" as used herein is intended to include all particulate and/or aggregate materials (e.g. gravel, sand, combinations, etc.) which are used or can be used in gravel pack or fracture completions. As known in the art, the "gravel" particles used in a particular situation are sized so as to block or filter out the particulates which may be produced with the well fluids or which are used to prop open a hydraulically-induced fractures in the formation.

The preset gravel 14 may be introduced into wellbore in any suitable manner, depending upon the actual circumstances involved with a particular completion zone 12. For example, where zone 12 lies in a relatively low pressured formation, gravel may be flowed down and out of the lower end of a workstring (not shown) which is lowered down the well and positioned above plug 15 or it may be dumped or pumped into the well at the surface and allowed to fall under the influence of gravity. The gravel may be flowed into the wellbore as a substantially dry mixture or as a slurry (mixed with a carrier fluid such as polymer-type, water-based fluid, crude oil, etc.). This type of gravel placement does not require high pressures thereby reducing fluid losses and/or potential damage to the formation. Further, if the situation and formation pressures allow, the gravel may be placed by standard squeeze operations which will insure good filling of perforations 12*a* with the gravel during the placement of the preset gravel 14.

After the preset gravel 14 is in place adjacent to zone 12, gravel pack well tool 17 is lowered into the wellbore. As illustrated, gravel pack well tool 17 is comprised of a first auger-liner assembly 20 which is connected onto the bottom of workstring 18 by means of release sub 19. First auger-liner assembly 20 is comprised of a first fluid-permeable liner 21 having an auger blade 22 welded or otherwise secured to and extending along the outer periphery thereof. "Fluid-permeable liner", as used herein, is meant to be generic and to include any and all types of liners (e.g. screens, slotted pipes, screened pipes, perforated liners, pre-packed screens and/or liners, combinations of same, etc.) which are used or could be used in well completions of this general type. As will be recognized by those skilled in the art, there are presently several known suppliers from whom such "liners" are readily commercially available. The liner may be of a continuous length, as shown, or it may be comprised of a plurality of segments connected by subs or "blanks".

Preferably, first auger-liner assembly 20 has a bit sub 24 at its forward end to initially contact and displace gravel onto auger blade 22 as the liner is rotated downward into the preset gravel 14. Auger blade 22 has basically the same configuration as known earth augers in that it is one or more continuous flightings and extends helically around the periphery of liner 20 and bit sub 24 and is secured thereto by any appropriate means, e.g. welding. The auger blade 22 extends sufficiently along the length of gravel pack tool 17 to insure that the auger-liner assembly 20 will be properly positioned within the preset gravel 14 to form the desired gravel pack completion. If first auger-liner assembly 20 is comprised of segments and blanks or if blank tubular sections 25 (one shown in FIG. 1) above auger-liner 21 are also to be positioned within gravel 14, auger blade 22 also preferably extends about the periphery of such blanks. For a further description of such a auger-liner and the method for installing same, see co-pending U.S. patent applications Ser. No. 07/518,046, filed, May 4, 1990 and now U.S. Pat. No. 5,036,920, issued Aug. 6, 1991, and Ser. No. 07/668,003, filed Mar. 12, 1991, both commonly assigned to the present assignee.

Well tool 17 includes a packer 26 which is positioned at or near the upper end of blank tubular section 25 and a length of flush joint pipe 27 which connects blank tubular section 25 to the releasable connection 19 on the lower end of workstring 18. Pipe 27 has a commercially-available sliding sleeve valve sub 28 therein and has a fish-neck seal plug 29 releasably secured in its upper end to prevent flow therethrough.

Again, as shown in FIG. 1, preset gravel 14 is placed adjacent completion zone 11 as described above. Well tool 17 is lowered on workstring 18 until it contacts the top of preset gravel 14. Workstring 18 is then rotated at the surface by a rotary table, power sub, or the like (none shown) to rotate auger-screen 20 and "auger" it downward into preset gravel 14. Since the gravel is mechanically moved upward and outward along rotating auger blade 22, there is no need to circulate fluid during installation.

Figure 2:
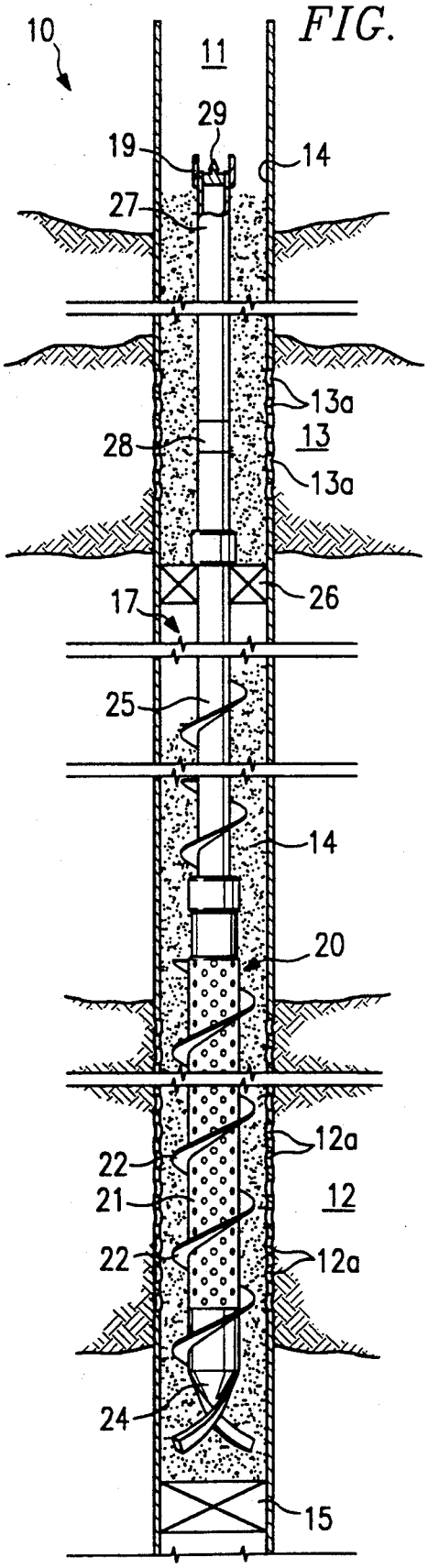
FIG. 2 is an elevational view, partly in section, of an intermediate stage of the present invention.

When auger-liner 20 is properly positioned in gravel 14, packer 26 is set and workstring 18 is released at connection 19 and is withdrawn leaving flush-joint pipe section 27 in the wellbore above packer 26. Next, sufficient additional gravel 30 is supplied down wellbore 11 and onto packer 26 and around pipe section 27 (FIG. 2) to fill the length of wellbore 11 adjacent upper zone 13 which is to be completed. Gravel 30 can be deposited in the wellbore in the same manner as described above in regard to the placement of gravel 14.

Figure 3:
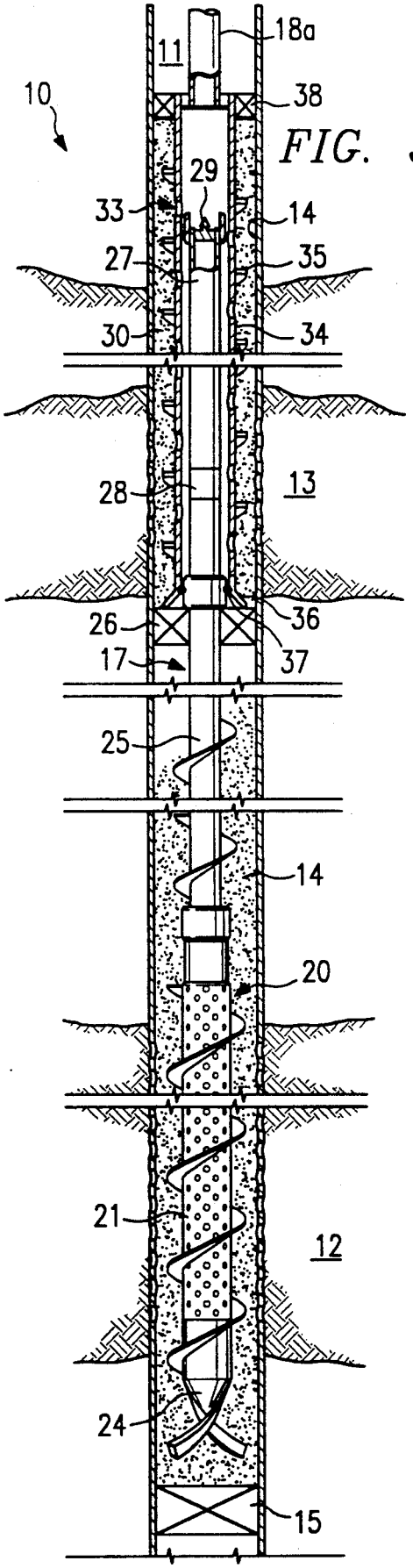
FIG. 3 is an elevational view, partly in section, of a further intermediate stage of the present invention.

Next, a second auger-liner assembly 33 is releasably connected to the lower end of workstring 18*a* (FIG. 3) and is lowered into wellbore 11. Second auger-liner assembly 33 is comprised of a second fluid-permeable liner 34 having an auger blade 35 secured around its periphery similarly as described above. A "fish-tail" mill 36 (e.g. three blades fish tail bit sub) is connected to the forward end of liner 34 and has an axial bore slightly larger than the diameter of flush-joint pipe section 27. Preferably, the opening into the bore of sub 36 is flared outwardly which aids in "picking-up" the upper end of pipe section 27 and directing it into the liner as the assembly 33 is rotated and augered into gravel 30. Seal means (e.g. O-ring 37) is positioned within assembly 33 to seal with pipe 27 when in an operable position and a setable packer 38 is fixed to the upper end of assembly 33.

When second auger-liner assembly 33 has been augered into position within gravel 30, workstring 18*a* is released and removed. Packer 38 is set to seal between assembly 33 and casing 14. If the fluid from zones 12 and 13 are to be commingled during production, a conduit means (e.g. production tubing string 18*c* (FIG. 4)) is lowered and stabbed-in or otherwised connected to connection 19. Packer 40 is provided on string 18*c* to seal between assembly 33 and string 18*c*. Plug 29 (FIG. 1) is removed by a wireline or the like (could be removed before pipe 18*c* is run in some instances) and sliding sleeve valve 28 is opened, again by wireline or the like.

Figure 4:
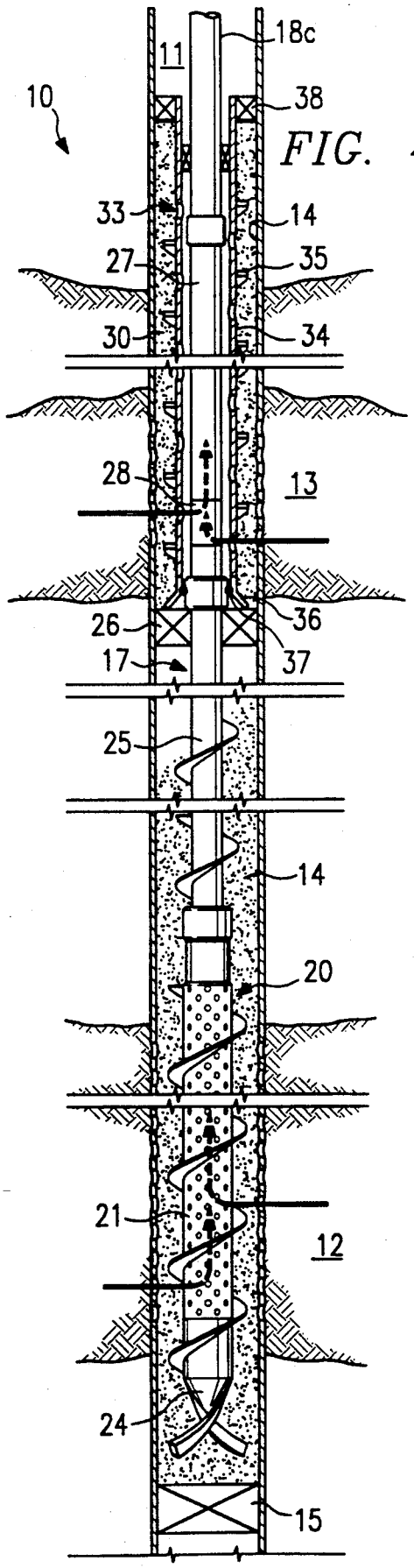
FIG. 4 is an elevational view, partly in section, of the completed multiple gravel pack well completion of the present invention wherein the fluids from upper and lower zones are commingled for production.

As can be seen in FIG. 4, flow from lower zone 12 flows through perforations 12*a*, gravel 14, into liner 21, and up therethrough to pipe 27 and string 18*c*. Flow from upper zone flows through perforations 13*a*, gravel 30, into liner 34, sleeve valve 28, and commingles with the flow from zone 12 for production to the surface through string 18*c*.

Figure 5:
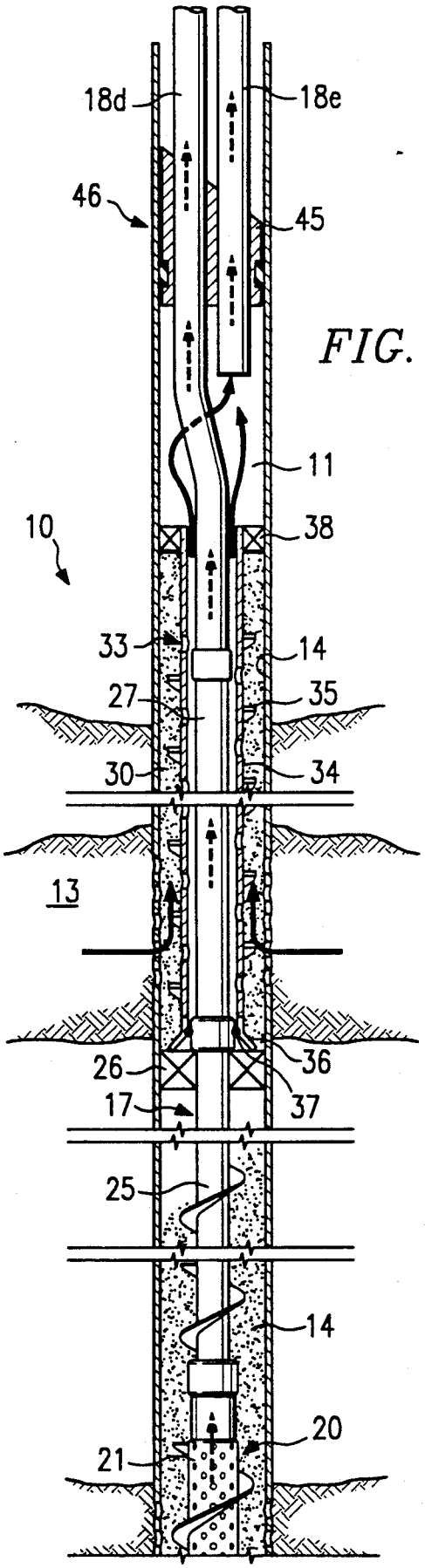
FIG. 5 is an elevational view, partly in section, of the completed multiple gravel pack well completion of the present invention wherein the fluids from upper and lower zones are produced separately.

If the fluids from zones 12, 13 are to be produced separately, dual completion tubing assembly 44 (FIG. 5) having a dual completion retrievable packer 45 is lowered and a first tubing 18*d* is stabbed-in or otherwise connected to connection 19. In this embodiment, sliding sleeve valve 28 is not needed and if present, is not opened. As seen in FIG. 5, fluids from lower zone 12 flow into liner 21 and upward into tubing 18*d* for production to the surface while the fluids from upper zone 13 flow into liner 34 and up the annulus surrounding pipe 27 into tubing 18*e* for production to the surface.

What is claimed is:

1. A method for multiple completing an upper and a lower zone within a wellbore, said method comprising:
   installing a gravel pack completion adjacent said lower zone;
   presetting particulate material in said wellbore adjacent said upper zone; and
   lowering an auger-liner assembly into said well bore and rotating said auger-liner into said preset particulate material to form a gravel pack completion adjacent said upper zone.

2. The method of claim 1 including:
   commingling fluids which flow through said upper and lower gravel pack completions from said upper and lower zones, respectively, for production to the surface.

3. The method of claim 1 including:
   producing fluids which flow through said upper and lower gravel pack completions from said upper and lower zones, respectively, separately to the surface.

4. The method of claim 1 including:
   setting a packer in said wellbore above said lower gravel pack completion and wherein said particulate material is preset on said packer.

5. The method of claim 1 wherein said the steps of installing said gravel pack completion adjacent said lower zone comprises:
   presetting particulate material in said wellbore adjacent said lower zone; and
   lowering an auger-liner assembly into said well bore and rotating said auger-liner into said preset particulate material to form a gravel pack completion adjacent said lower zone.

6. A method for forming a multiple gravel pack completion in a wellbore transversing an upper zone and a lower zone, said method comprising:
   filling said wellbore adjacent said lower zone with a particulate material;
   lowering a first fluid-permeable liner having an auger blade about its periphery on a workstring into said wellbore;
   rotating said workstring to auger said liner into said particulate material to form a lower gravel pack completion adjacent said lower zone;
   setting a packer in said wellbore above said lower gravel pack completion;
   placing additional particulate material on said packer to fill said wellbore adjacent said upper zone;
   lowering a second fluid-permeable liner having an auger blade about its periphery on a workstring into said wellbore; and
   rotating said workstring to auger said second liner into said additional particulate material to form a gravel pack completion adjacent said upper zone.

7. The method of claim 6 including:
   establishing a common flow path between the surface of wellbore and said lower and said upper gravel pack completions whereby fluids from said upper and lower zones are commingled for production.

8. The method of claim 6 including:
   establishing separate flow paths between the surface of said wellbore and said upper and said lower gravel pack completions, respectively, whereby fluids from said upper and lower zones are produced separately.

9. A multiple gravel pack well completion in a wellbore tranversing an upper zone and a lower zone comprising:

particulate material in said wellbore adjacent said lower zone;

a first fluid-permeable liner having an auger blade about its periphery positioned within said particulate material adjacent said lower zone to form a lower gravel pack completion;

a packer in said wellbore between said lower gravel pack completion and said upper zone;

additional particulate material in said wellbore above said packer and adjacent said upper zone;

a second fluid-permeable liner having an auger blade about its periphery positioned within said additional particulate material to form an upper gravel pack completion; and conduit means for producing fluids from said lower zone and said upper zone to the surface of said wellbore.

10. The multiple gravel pack well completion of claim 9 wherein said conduit means comprises:

a conduit extending from the surface through said second fluid-permeable liner and said packer, and connected to said first fluid-permeable for commingling the production of fluids from said upper and lower zones.

11. The multiple gravel pack well completion of claim 10 including:

valve means in said conduit within said second fluid-permeable liner which when in an open position allows flow through said upper gravel pack completion and into said conduit.

12. The multiple gravel pack well completion of claim 11 wherein said valve means comprises:

a sliding sleeve valve in said conduit.

13. The multiple gravel pack well completion of claim 9 wherein said conduit means comprises:

a first conduit extending from the surface through said second fluid-permeable liner and packer and connected to said first fluid-permeable liner through which fluids from said lower zone can be produced to the surface; and a second conduit extending from the surface and in fluid communication with said second fluid-permeable liner through which fluids from said upper zone can be produced.

* * * * *